United States Patent [19]

Boisrayon et al.

[11] 3,933,109

[45] Jan. 20, 1976

[54] BUOY RELEASABLE FROM A SUBMARINE

[75] Inventors: Gérard M. Boisrayon, Ollioules; Gilbert M. Martin, La Seyne; Gabriel M. Delfosse, La Garde, all of France

[73] Assignee: Etat Francais, Paris, France

[22] Filed: Nov. 29, 1973

[21] Appl. No.: 420,161

[30] Foreign Application Priority Data

Nov. 30, 1972 France ..... 72.42521

[52] U.S. Cl. ..... 114/16.5; 9/8 R; 9/9

[51] Int. Cl.[2] ..... B63G 8/00

[58] Field of Search ..... 114/16.5; 9/9, 8 R, 10, 9/8.3 R, 8.3 E

[56] References Cited

UNITED STATES PATENTS

| | | | |
|---|---|---|---|
| 927,772 | 7/1909 | Brust | 9/9 |
| 1,188,514 | 6/1916 | Blaaderen | 9/10 |
| 1,510,595 | 10/1924 | Hodgson | 9/8 R |
| 2,470,783 | 5/1949 | Mead | 9/9 |
| 3,217,599 | 11/1965 | Meeker | 9/8 R |
| 3,253,810 | 5/1966 | Penn | 9/9 |
| 3,529,562 | 9/1970 | McLaren | 114/16.5 |
| 3,581,693 | 6/1971 | Basset | 114/16.5 |
| 3,583,657 | 6/1971 | Boyce | 9/9 |

*Primary Examiner*—Trygve M. Blix
*Assistant Examiner*—Charles E. Frankfort
*Attorney, Agent, or Firm*—Haseltine, Lake & Waters

[57] ABSTRACT

A distress buoy releasable from a submarine comprising two hemispherical portions sealably joined to form a hollow spherical body mounting a radio transmitter with deployable antenna, a radar responder with antenna, a beacon light, a tape recorder containing information recorded over a time period before release, and electrical power cells. A ring of float members is secured to and surrounds the spherical body.

3 Claims, 3 Drawing Figures

BUOY RELEASABLE FROM A SUBMARINE

FIELD OF THE INVENTION

The invention relates to a distress buoy for a submarine which is disposed in a recess open at the top in a structure mounted at the top of the hull of the submarine, the buoy being releasable manually or automatically in case of distress thereby to ascend to the surface of the water and emit signals to enable its discovery.

BACKGROUND

There have been utilized buoys which are released from submarines at the time of distress and which remain connected to the submarine by a conductor cable permitting communication with the interior of the submarine. The presence of the connection cable produces constraints which are eliminated in utilizing distress buoys which float freely at the surface.

The buoy of the invention is of the latter type.

There are known separable distress buoys essentially constituted as hollow bodies containing signal transmitters, for example, of visible signals such as smoke or luminous signals, or radio signals.

There are also known such buoys constituted by a spherical body, the spherical shape presenting the best resistance to crushing during immersion. Nevertheless, the spherical shape also presents the disadvantage of lacking stability when the buoy floats at the surface of the water and drifts, this being very serious since if the buoy capsizes, it can no longer be discovered.

SUMMARY OF THE INVENTION

An object of the invention is to provide a distress buoy which is free of the disadvantages as noted above.

This object is achieved by a distress buoy comprising a hollow central spherical body containing at least one electrical power source, such as a battery, a radio transmitter and/or a generator of luminous signals and a ring of auxiliary floating members fixed to the periphery of the spherical body at the upper portion thereof, i.e. above a diametral plane therethrough.

The auxiliary floating members are preferably spherical in shape and composed of a cellular or foam material.

Conventional spherical buoys are subjected to a constant bobbing movement i.e. a vertically oscillating movement in which the buoy is more or less submerged in the water, according to sea swell and surging, to cause deterioration of the operating apparatus and disturbance of the emissions to make discovery of the buoy very difficult. The ring of auxiliary floating members augments the floatability and stability of the buoy and reduces bobbing without substantially increasing the size of the recess in the structure at the top of the hull of the submarine which is to receive the buoy.

The auxiliary peripheral floating members according to the invention are mounted at a level below the top of antennae and signal lights carried by the central spherical body so as not to interfere with their transmission and the reception of signals by the buoy and the discovery and location thereof which is of ultimate importance.

The known release buoys includes means for emitting signals which permit location thereof to localize the area of search for the submarine, but it furnishes no information concerning the cause and the circumstances of an accident and no information can be obtained from the crew of the submarine as there is no connection with the submarine to enable communication therewith.

It is another object of the invention to provide means in a distress buoy furnishing information concerning the circumstances and, if possible, the causes of an accident and also the extent of damage.

This objective is achieved by placing a recorder in the interior of the central spherical body to record information measured at the interior of the submarine to provide a permanent record over a pre-determined period preceding the release of the buoy, the recorder being connected to the submarine by a multiconductor cable which is sheared at the time of buoy release, the cable being connected to the central spherical body by a water-tight connection.

Such recorder means is preferably constituted by a tape recorder operative with an endless tape comprising at least one track for voice recording.

It is already known to place recorders on board aircraft or other vehicles to enable reconstruction of the circumstances of an accident after its occurrence.

Unfortunately, the use of such recorders to furnish valuable information which might prevent repetition of certain accidents has not been presently undertaken in submarines since, in general, the vessel remains inaccessible.

The installation according to the invention of such a recorder in a releasable buoy permits using these recorders in the case of submarines to contribute to the discovery of the causes of accidents in order to remedy them.

The presence of a tape recorder in the buoy permits the crew to record by voice the circumstances at the imminence of an accident and such recordings contribute to an explanation of the causes and circumstances of the accident.

The use of a multiconductor cable between the buoy and the interior of the submarine enables it to transmit electrical energy without interruption from a charging source in the submarine to a row of storage batteries up to the time of release of the buoy.

The presence of the storage batteries constantly maintained at full charge assures that the buoy will have an operative electrical energy source after buoy release, whereas, in contrast, dry cell batteries placed in the buoy over a long time and not periodically checked could be dead at the time of release and prevent location of the buoy.

The locating of distress buoys at the surface of a body of water is known to be a difficult operation when such buoys are only provided with smoke markers, beacon lights or radio transmitters.

Another object of the invention is to place in the spherical body a radar responder whose antenna is situated in a dome mounted at the top of the spherical body.

DETAILED DESCRIPTION

Figure 1:
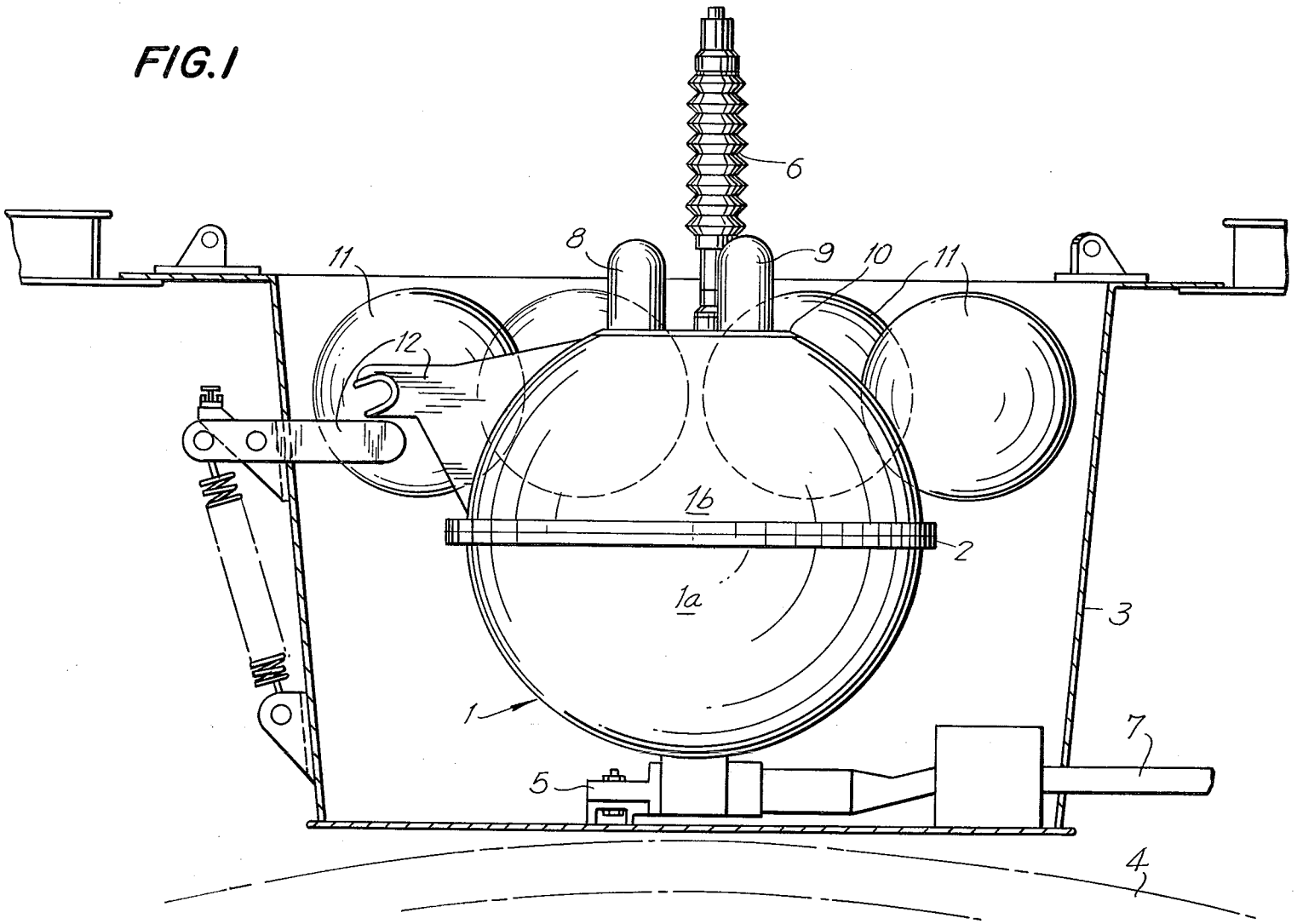
FIG. 1 is an elevation view of a buoy according to the invention emplaced in a recess in a body of a submarine.

Referring to FIG. 1 therein is seen a buoy formed of two hemispherical portions 1*a* and 1*b* assembled in sealed relation by flanges thereon to form a water-tight joint 2.

The buoy is placed in a recess 3 which flares upwardly and has an open top, said recess being formed in a structure at the top of the hull 4 of a submarine. Such recess can be provided in the conning tower of the submarine. The buoy is secured at the bottom of the recess by means of two pyrotechnically operated shackles 5 which are controlled manually or automatically as a function of such conditions as depth of immersion, or the presence of water in certain compartments of the submarine.

When the shackles 5 are actuated pyrotechnically, they open and release the buoy which is now buoyant and free to rise to the surface of the water.

Such buoys can carry a radio transmitter to act as a beacon and send radio signals, such transmitters being well known in the art.

FIG. 1 shows an antenna 6 for such transmitter which is deployed automatically at the time when the buoy is freed.

The buoy according to the invention differs from conventional buoys by the construction wherein it contains not only a radio transmitter but also a tape recorder to permanently record information provided from the interior of the submarine. For this purpose, the tape recorder is connected to the interior of the submarine by a multiconductor cable 7.

The buoy according to the invention further comprises bright beacon light 8 and a radar responder 9. The upper spherical portion 1*b* is truncated at its top and sealingly closed by a plate 10 on which are mounted the beacon light 8, the radar responder 9 and the antenna 6.

The buoy of the invention is further characterized by a ring of auxiliary floating members 11 at the periphery of upper spherical portion 1*b*. These floating members are constituted, for example, as balls of cellular material. These auxiliary floating members increase the floatability or buoyancy of the buoy such that at the time of release, the force of ascension is greatly increased, which reduces the risk of jamming of the buoy in its recess, for example, in the case when the submarine is inclined and the opening of the recess is not turned exactly straight up.

The second function of the floating members is to eliminate the phenomena of bobbing of the buoy when it floats at the surface of the water, i.e. to avoid continual variation in depth immersion of the buoy as a result of sea swell. The hydrostatic pressure on the buoy is augmented by the floating members and the buoy follows the movements of the swell at a substantially constant depth of immersion, the float line being situated above the horizontal median plane of the floating bodies.

The floating members 11 confer to the buoy a better stability of shape and prevent capsize thereof as is common with ordinary spherical buoys. Moreover, the members 11 are mounted above the median diametral plane of spherical body 1 but extend below the level of beacon light 8 and antennas 6 and 9 so as not to interfere with the operation thereof.

As seen additionally in FIG. 1, there is a conventional hydraulic locking arrangement 12 to hold the buoy in the recess during navigation on the surface.

Figure 2:
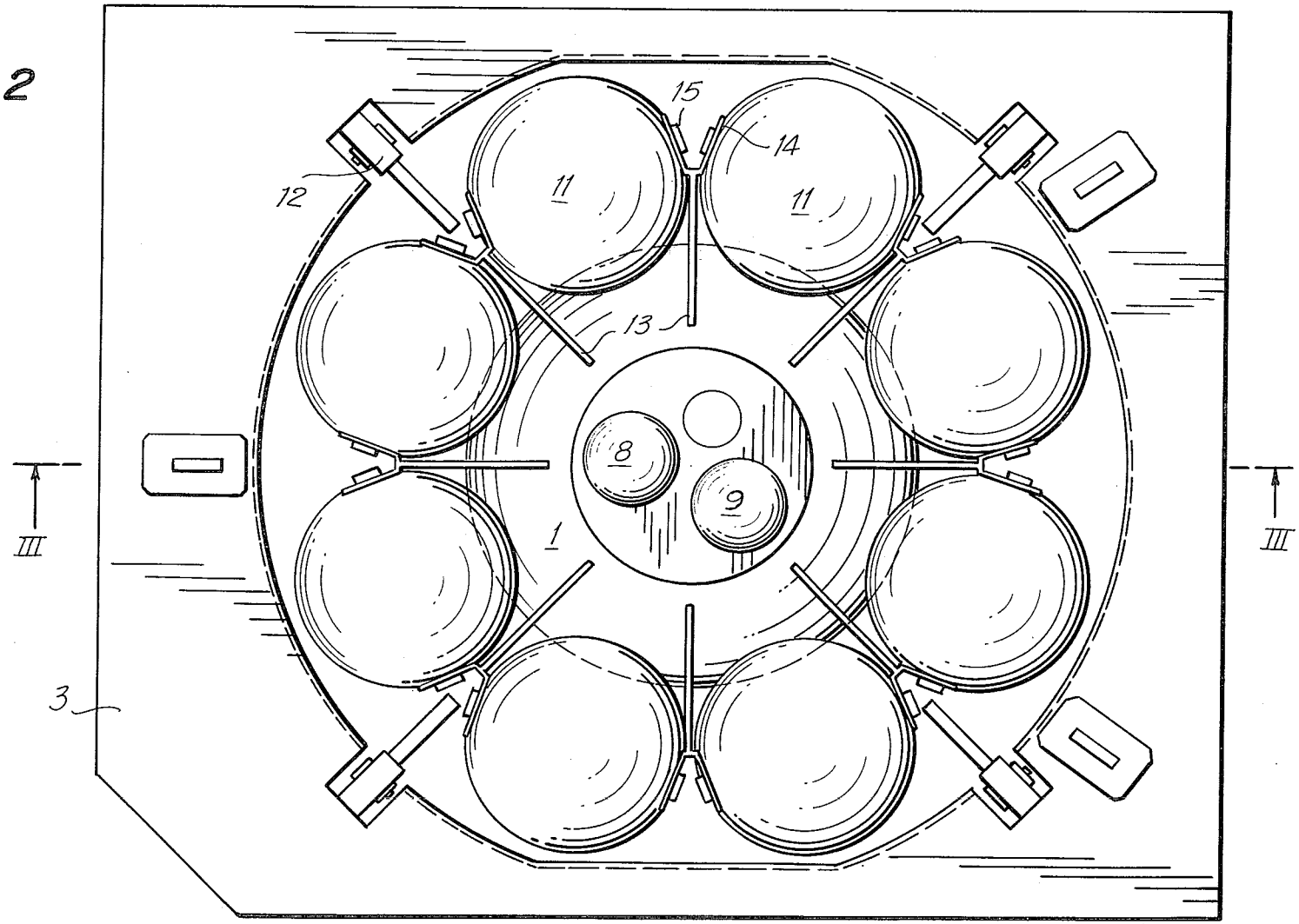
FIG. 2 is a top plan view of the structure in FIG. 1.

FIG. 2 shows the ring of floating members to be composed of eight members 11 joined together. They are connected to the spherical body 1 by supports 13 welded to the outer wall of the hemispherical portion 1*b* and terminating at fork 14. Bolts 15 pass in bores extending completely through the floating members 11 and are received in forks 14.

Figure 3:
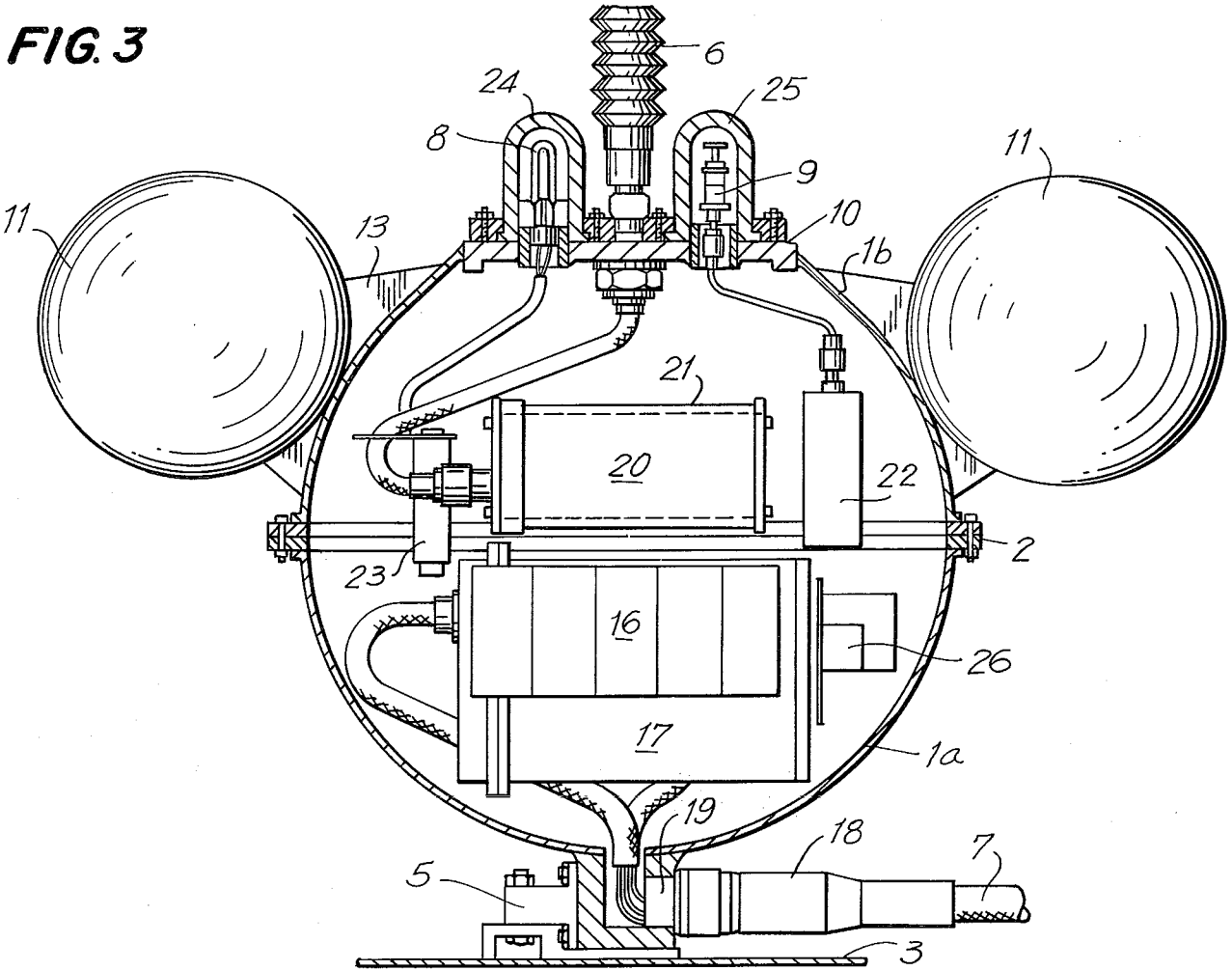
FIG. 3 is a sectional view taken along line III—III in FIG. 2.

FIG. 3 shows on enlarged scale the apparatus placed in in the buoy. In this figure are also seen the hemispherical portions 1*a* and 1*b* assembled together by their flanges 2 and the floating members 11. The plate 10 is also visible carrying the antenna 6 of the transmitter, the beacon light 8 and the antenna 9 of the radar responder. Further seen in detail is the pyrotechnical shackle 5 fixing the buoy at the bottom of recess 3 and the cable 7 connecting the buoy to the interior of the submarine.

At the interior of the buoy are disposed the following apparatus.

Two rows of batteries 16 which are constantly maintained at maximum charge by an electrical connection with a charger situated in the interior of the submarine and connected thereto by cable 7. The batteries 16 are, for example, nickel-cadmium batteries which do not emit any gases during charging.

A tape recorder 17 is also connected to the interior of the submarine by the cable 7.

The tape recorder can be of the endless band type and comprises a plurality of tracks permitting recording in binary form, for example, information from the interior of the submarine. Such information can include engine speed, interior pressure in the submarine, trim, course, depth, periscope position etc.

The tape recorder also includes one or more tracks permitting voice recording either continuously at certain locations or of information which the crew may wish to transmit in case of distress.

The tape recorder can continuously record a permanent record of information of the above sort over a determined period, for example, 10 hours preceding release of the buoy.

Thanks to this information, it is possible to reconstruct the circumstances and also the causes of an accident.

The buoy thus functions at times of distress in the same way as the so-called "black-box" of aircraft to enable determination of the causes of an accident.

The adaptation of such an arrangement in submarines has not been previously effected as it necessitated a connection by a cable between the buoy and the submarine which must obviously be sealed.

The electric cable 7 is automatically sheared at the time of release of the buoy by a pyrotechnical shearing device (not shown) of known construction. The cable is connected to the buoy by a sealed connector 18 which includes a sealed coupling 19 by which the cable enters the buoy.

In the buoy is a radio transmitter 20 which emits periodic signals at a determined frequency and at given intervals to permit locating the buoy.

The transmitter is fed by batteries 21, which, for example, can be mercury batteries which are activated automatically at the time of release of the buoy.

Also mounted in the buoy is a radar responder 22 provided with an antenna 9. The radar responder, of known design, permits obtaining a radar echo of an object of small size such as the buoy. The responder is composed of a receptor which receives radar signals from an emitter and also a transmitter which emits at this time a responding transmission to the radar screen of a search vessel. The radar responder is fed by the batteries 16.

At the interior of the buoy is also mounted a generator 23 for feeding the beacon light 8. The generator is driven by the batteries 16. It is possible to include an automatic control to interrupt the operation.

The beacon light 8 and the antenna of the radar responder 9 are placed in sealed transparent covers made, for example, of methyl methacrylate.

The electric cables extend to the interior of these covers via sealed connections in plate 10 such that in the event of breakage of the covers, the interior of the buoy will not be flooded.

In order to maintain the apparatus in place in the interior of the buoy, padding of cellular material, such as polystyrene foam is interposed between the apparatus and the walls of the buoy.

At the interior of the buoy are placed diverse relays and printed circuits at 26 to effect the automatic control of the transmitter, the radar responder, and the beacon lights.

The buoy thus described essentially comprises three emitters to enable its discovery, two sources of electrical energy, a tape recorder of information, and the auxiliary floating bodies which stabilize the buoy on the water surface.

Numerous variations and modifications of the disclosed buoy will become evident to those skilled in the art within the framework of the invention as defined in the appended claims.

What is claimed is:

1. A distress buoy for a submarine adapted to be mounted in an open recess in the top of a structure on the outside of the hull of the submarine, and adapted to be released to float freely at the surface of the water, said buoy comprising a hollow central spherical body containing at least one electrical power source and signal generator means connected to said source, a ring of auxiliary solid float members, and means fixing said ring of float members to said central spherical body at the upper portion thereof, said float members being fixed to said body to be disposed against the same so that said auxiliary float members are closely bound to follow all the movements of said central spherical body, said auxiliary float members being constituted of spherical blocks of cellular material having diametral bores, said means for fixing the float members to said body comprising mounting plates fixed to the upper portion of said spherical body between adjacent auxiliary floats and shafts mounted in said bores and fixed to said plates, said mounting plates being fixed to the upper portion of said spherical body in diametral planes of said spherical body.

2. A distress buoy as claimed in claim 1 comprising tape recorder means in said spherical body for automatically recording continuous information concerning the operation of the submarine over a given time period prior to the release of the buoy, said recorder means having at least one track for further recording of an oral message from the submarine crew, a multi-conductor cable connecting said recorder means to the interior of the submarine and means for shearing the multi-conductor cable at the time of release of the buoy.

3. A distress buoy as claimed in claim 1 comprising pyrotechnically operated shackles releasably connecting said central body and the structure of the submarine.

* * * * *